US011414871B2

(12) United States Patent
Dellal et al.

(10) Patent No.: US 11,414,871 B2
(45) Date of Patent: Aug. 16, 2022

(54) LIMITING ICE AND ICE DAM FORMATION AND RELATED METHODS AND DEVICES

(71) Applicant: Floe, LLC, Boston, MA (US)

(72) Inventors: David Dellal, New York, NY (US); Anna Fountain, Boston, MA (US); Joanna Zhu, Fresh Meadows, NY (US)

(73) Assignee: FLOE INC., New Haven, CT (US)

( * ) Notice: Subject to any disclaimer, the term of this patent is extended or adjusted under 35 U.S.C. 154(b) by 0 days.

(21) Appl. No.: 16/163,072

(22) Filed: Oct. 17, 2018

(65) Prior Publication Data

US 2019/0112815 A1 Apr. 18, 2019

Related U.S. Application Data

(60) Provisional application No. 62/574,154, filed on Oct. 18, 2017.

(51) Int. Cl.
*E04D 13/10* (2006.01)
*E04D 13/076* (2006.01)

(52) U.S. Cl.
CPC ..... *E04D 13/103* (2013.01); *E04D 13/0762* (2013.01)

(58) Field of Classification Search
CPC ..... E04D 13/103; E04D 13/0762
USPC ..... 239/542, 547
See application file for complete search history.

(56) References Cited

U.S. PATENT DOCUMENTS

| | | | | |
|---|---|---|---|---|
| 3,688,784 | A * | 9/1972 | Daum | B05B 3/001 134/123 |
| 4,058,257 | A * | 11/1977 | Spencer | A01G 25/023 239/107 |
| 4,183,368 | A | 1/1980 | Husted | |
| 5,890,322 | A | 4/1999 | Fears | |
| 6,042,023 | A * | 3/2000 | Ask | E01H 10/005 239/1 |
| 6,282,846 | B1 | 9/2001 | Nocella | |
| 9,144,814 | B2 | 9/2015 | Mercnik et al. | |
| 2006/0060664 | A1 | 3/2006 | Valiton et al. | |
| 2013/0048029 | A1 | 2/2013 | Vercouteren | |

FOREIGN PATENT DOCUMENTS

| | | | |
|---|---|---|---|
| AU | 2009296711 | B2 | 4/2010 |

* cited by examiner

*Primary Examiner* — Steven M Cernoch
(74) *Attorney, Agent, or Firm* — Proskauer Rose LLP

(57) ABSTRACT

In some aspects, deicer systems to distribute a deicing fluid along a roof of a building to limit ice dam formation can include: a pre-pressurized water source that provides pressurized water; a deicer solution source containing a deicer solution; a passive mixing system in fluid communication with the pre-pressurized water source and the deicer solution source, the passive mixing system being configured to combine the pressurized water and the deicer solution to form a deicer fluid; and one or more emitters configured to be disposed along the roof, the emitters being in fluid communication with the passive mixing system to receive the deicer fluid and dispense the deicer fluid along the roof. In addition, certain systems described herein can be run with an electric pump.

7 Claims, 10 Drawing Sheets

LIMITING ICE AND ICE DAM FORMATION AND RELATED METHODS AND DEVICES

CROSS-REFERENCE TO RELATED APPLICATION

This application claims the benefit of U.S. Provisional Patent Application No. 62/574,154, which was filed on Oct. 18, 2017 and entitled "Limiting Ice and Ice Dam Formation and Related Methods and Devices," the entire contents of which are hereby incorporated herein by reference.

TECHNICAL FIELD

This application relates generally to de-icing, and more specifically to limiting ice and ice dam formation and related methods and devices.

BACKGROUND

An ice dam is a ridge of ice that forms at the edge of a roof and prevents melting snow from draining off a roof. The water that backs up behind the ice dam can leak into a home and cause damage to walls, ceilings, insulation, and other areas. Some conventional deicing systems can include heating elements that prevent ice dam formation, but such elements are prone to elevated risks such as house fires (see, e.g., https://www.contractormag.com/columns/yates/cm column 456—page accessed Oct. 11, 2018). Some other conventional deicing systems include pumping a deicing solution to melt ice dams. However, no conventional deicing system teaches, suggests, or discloses a cost-efficient method of melting and preventing ice dams regardless of the source of the water or power to the building, and regardless of whether there was a loss of power to the system.

SUMMARY

In some aspects, the systems and methods described herein relate to systems for removing and preventing ice dams regardless of the source of the water to the building, and regardless of whether there was a loss of power to the system.

A common ice dam prevention system incorporates large heating elements that are costly to install and operate, as well as being aesthetically unappealing to many homeowners. Importantly, however, these traditional systems require power to operate.

Unfortunately for New England homeowners, the weather conditions that are conducive to ice formation are often accompanied by downed trees and power lines. Blizzards or ice storms can cause widespread power outages. For example, one storm in March of 2017 left over 60,000 customers without power in Massachusetts alone. (See, e.g., http://www.masslive.com/weather/indes.ssf/2017/03/60000 power outages reported a.html—page accessed Oct. 11, 2018).

Despite the frequency of power outages, no conventional deicing system teaches, suggests, or discloses a cost-efficient method of melting and preventing ice dams regardless of the source of the water to the building, and regardless of whether there was a loss of power to the system. Therefore, it is an object of the systems and methods described herein to provide both urban and rural properties the advantages associated with a low-cost, environmentally friendly, aesthetically pleasing system that is operable when connected to either city water or a well, and that incorporates the ability to provide easy and safe ice dam removal and prevention even if there is a loss of power to the system.

In one aspect, the invention features a deicer system to distribute a deicing fluid along a roof (and also possibly in a gutter) of a building (e.g., a house or an office) to limit or mitigate ice dam formation. The deicer system includes a pre-pressurized water source that provides pressurized water. The deicer system also includes a deicer solution source containing a deicer solution. The deicer system also includes a passive mixing system in fluid communication with the pre-pressurized water source and the deicer solution source. The passive mixing system is configured to combine the pressurized water and the deicer solution to form a deicer fluid. The deicer system also includes one or more emitters configured to be disposed along the roof. The emitters are in fluid communication with the passive mixing system to receive the deicer fluid and dispense the deicer fluid along the roof.

In some embodiments, the emitters include holes for depositing the liquid deicing solution. In some embodiments, the emitters are drip emitters. In some embodiments, the deicer system includes one or more sensors configured to predict environment conditions that promote ice dam formation. In some embodiments, the one or more sensors are configured to permit flow of the pressurized water to the passive mixing system when environmental conditions that promote ice dam formation are predicted. In some embodiments, the system further includes a valve to limit flow between the pre-pressurized water source and the passive mixing system. In some embodiments, the emitters are configured to dispense the deicer fluid at a pressure of less than about 70 psi. In some embodiments, the emitters are configured to dispense the deicer fluid at a pressure of greater than about 70 psi. In some embodiments, the pre-pressurized water source comprises a municipal water supply. In some embodiments, the pre-pressurized water source comprises a residential water well. In some embodiments, the pre-pressurized water source comprises a water container elevated relative to the emitters. In some embodiments, the pre-pressurized water source comprises a manual water pumping system.

In some embodiments, the sensors are configured to determine an amount of deicer solution disposed on the deicer solution source. In some embodiments, the deicer solution source comprises a container containing deicer solution. In some embodiments, the deicer solution source is disposed beneath the passive mixing system. In some embodiments, the passive mixing system comprises a venturi system. In some embodiments, the venturi system receives the pressurized water and, in response to a low pressure region created by constriction of the flow path of the pressurized water, draws deicer solution from the deicer solution source. In some embodiments, the venturi system mixes the pressurized water and the deicer solution at a predetermined ratio. In some embodiments, the venturi system mixes the pressurized water and the deicer solution to form a deicer fluid that comprises about 30% to about 99% deicer solution. In some embodiments, the passive mixing system is configured to mix the pressurized water with the deicer solution to form deicer fluid and dispense the deicer fluid along the roof with no electricity consumed from the building. In some embodiments, the deicer solution source comprises a sensor to determine deicer solution levels. In some embodiments, the deicer solution source comprises a unique connection to the passive mixing system. In some embodiments, the deicer solution is non-corrosive. In some embodiments, the deicer solution is biodegradable.

In another aspect, the invention features a method for limiting or mitigating ice dam damage. The method includes providing a deicer fluid source including a deicer fluid. The method also includes transporting the deicer fluid through a tube or cable to a roof. The method also includes depositing the deicer fluid on the roof (and also possibly in a gutter) using one or more emitters disposed along the roof, the emitters in fluid communication with the deicer fluid source to receive the deicer fluid and dispense the deicer fluid along the roof.

In some embodiments, providing a deicer fluid source including a deicer fluid further includes: providing pre-pressurized water from a pressurized water source; and combining the pre-pressurized water with a deicer solution to form the deicer fluid using a passive mixing system in fluid communication with the pre-pressurized water source. In some embodiments, providing a deicer fluid source including a deicer fluid occurs using an electric pump in fluid communication with the deicer fluid source. In some embodiments, the electric pump is connected to an electrical outlet or is battery powered. In some embodiments, the depositing occurs before snowfall to prevent ice dam formation. In some embodiments, the depositing occurs during snowfall to combat ice dam formation. In some embodiments, the depositing occurs after snowfall to fabricate channels in an ice dam formed on the roof.

In another aspect, the invention features a deicer system to distribute a deicing fluid along a roof (and also possibly in a gutter) of a building (e.g., a house or an office) to limit ice dam formation. The deicer system includes a deicer solution source including a deicer solution. The deicer system also includes an electric pump in fluid communication with the deicer solution source. The electric pump is configured to distribute the deicer solution. The deicer system includes one or more emitters in fluid communication with the deicer solution source. The emitters are configured to be disposed along the roof to receive the deicer fluid and dispense the deicer fluid along the roof.

In some embodiments, the deicer system further includes one or more sensors configured to predict one or more environmental conditions that promote ice dam formation. In some embodiments, the sensors are configured to permit flow of the pressurized water to the passive mixing system when the environmental conditions that promote ice dam formation are predicted. In some embodiments, the emitters include holes for depositing the liquid deicing solution. In some embodiments, the emitters are drip emitters. In some embodiments, the emitters are configured to dispense the deicer fluid at a pressure of less than about 70 psi. In some embodiments, the deicer solution source comprises a container containing deicer solution. In some embodiments, the electric pump is connected to an electrical outlet or is battery powered.

DETAILED DESCRIPTION

For the automated removal and prevention of ice dams, the new systems and methods disclosed herein can be used to transport fluid, such as deicer fluid, to a selected surface despite the loss of power and/or water pressure to the system. In some embodiments, the systems and methods as described herein include a method of distributing a fluid onto a first selected surface. In some embodiments, the systems and methods as described herein include a system of distributing a fluid onto a first selected surface. In some embodiments, the systems and methods as described herein include a method of preventing ice dam formation. In some aspects, systems described herein can have the following advantages, including providing users the ability to remove and prevent ice dams regardless of the water supply and despite suffering from power outages. In some aspects, systems described herein can be run with an electric pump (e.g., one that is connected to an electrical outlet or is battery powered).

Figure 1:
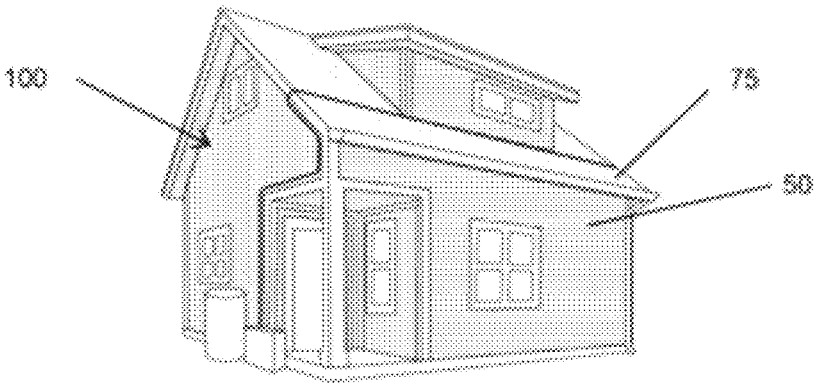
FIG. 1 is a perspective view of an example deicer system applied externally to a residential home.
Figure 2:
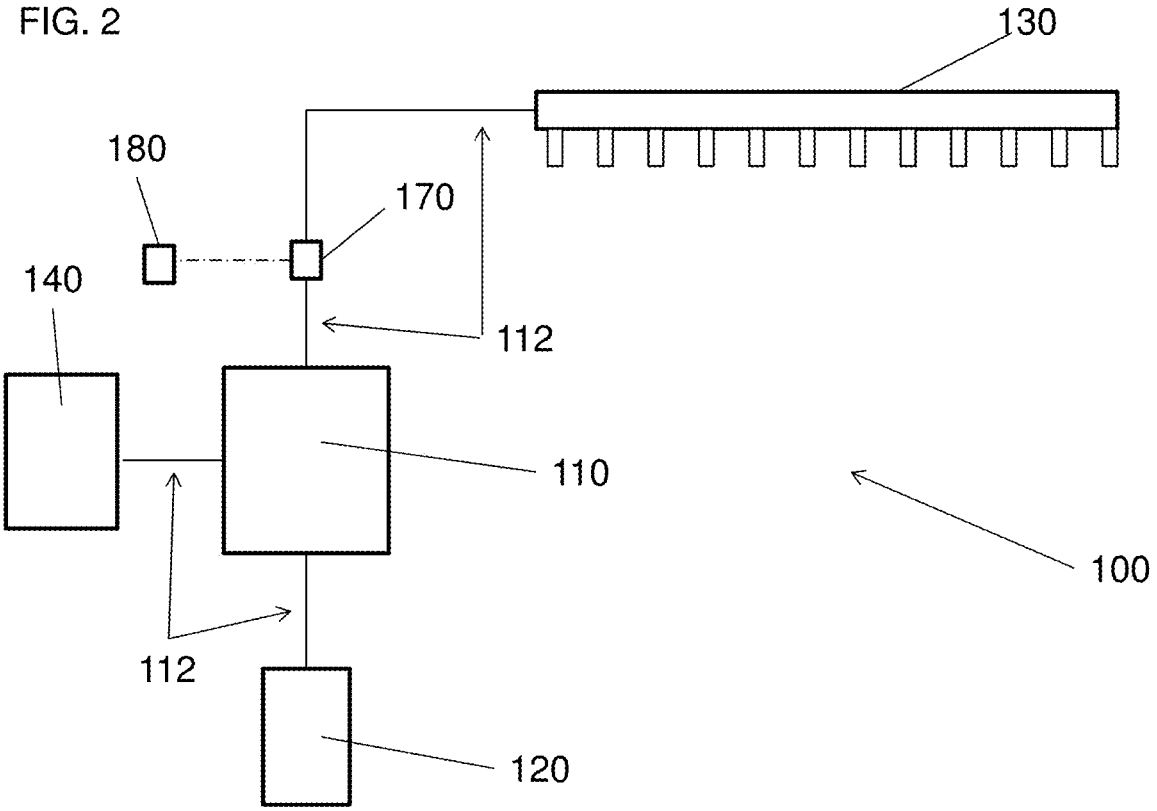
FIG. 2 is a schematic diagram illustrating an example deicer system.

Referring to FIG. 1 and the schematic of FIG. 2, in some embodiments, an example deicer system 100 can be arranged on or along one or components of living structure (e.g., a house) 50 and be configured to limit (e.g., reduce or prevent) the formation and build-up of ice dams along one or more selected surfaces 75 of the house 50, such as a roof surface at or near the gutter end of the roof (e.g., a rooftop).

For example, the system 100 can include one or more fluid emitters 130 used to distribute deicer fluid to the desired selected surfaces (e.g., roof) 75. The deicer fluid can be used to melt or otherwise form flow channels within or through an existing ice dam to promote better liquid flow off of the roof 75. As described in detail below, the emitters 130 can include any of various fluid dispensers to expel deicer fluid, typically, at relatively low pressures.

The system 100 can also include a water source 140 that utilizes its inherent water pressure to propel water through tubing 112 to a passive mixer 110. The water is typically mixed with a deicer solution from a deicer solution container 120 to together form a deicer fluid. In some cases, the system 100 can be configured to form (e.g., mix, blend, or otherwise combine the water and deicer solution) a deicer solution of a predetermined concentration. A solenoid valve 170 can be operated by a sensor suite 180 and control the flow of deicer fluid to the emitters 130.

The water source 140 provides water to the system 100. In some embodiments, the water source 140 is connected to an existing pressurized water source, such as a city water supply. Alternatively or additionally, in some embodiments, the water source 140 can include a residential well. Alternatively or additionally, in some embodiments, the water source 140 can include an alternative container (e.g., water holding container), by way of example and not limitation, a 55 gallon drum.

The tubing 112 connects most or all fluid handling components of the deicer system 100 and allow for the flow of the deicer fluid to the emitters 130. The tubing 112 can be made from any commonly used tubing material, by way of example and not limitation, PVC, metal tubing, and/or rubber tubing. As used herein, the term tubing can include any of various flow conduits configured to facilitate flow of a fluid therefore, such as tubing, piping, conduit or other structures made of rigid, flexible, and/or braided materials.

The passive mixer 110 is a component or device that can mix two or more liquids, such as to be combined at a predetermined ratio, without the need for additional electricity or active, moving components. Additional electricity in this context can refer to electricity other than that used to propel one of the liquids relative to the others with which it is mixed. As used herein, the term passive mixer or passive mixing can be used to refer to any component that does not require an additional pump or other electrically controlled device to ensure proper mixing of the two or more liquids. In some cases, the system described herein can take advantage of water pressure provided from a city water supply or hydrostatic pressure from a water column to facilitate mixing. For example, in some embodiments, the passive mixer relies on the venturi effect. The venturi effect is the reduction in fluid pressure that results when a fluid flows through a constricted section (or choke) of a pipe. For example, a base fluid (e.g., a diluent fluid (e.g., water)) can flow through a constriction of a pipe, which generates a low pressure region in the pipe. A second fluid (e.g., the active ingredient fluid (e.g., a deicer solution)) can be drawn into the pipe by the low pressure region, such that the deicer solution mixes with the water and is carried away in the pipe. For example, the venturi effect facilitates the mixing of water and deicer solution, thereby creating a deicer fluid, by creating a pressure differential that draws deicer solution from the deicer solution container 120 into the water flow at a controlled rate. By way of example and not limitation, the passive mixer can be a HydroBlend® Model #6850. As the mixing is accomplished automatically by the reliability of fluid mechanics, no power supply is required to maintain or monitor the mixing process. As discussed above, the description of no power supply can be exclusive of a power or pressure used to pressurize the water to flow through the venturi pipe.

The deicer solution container 120 contains the deicer solution and is connected to the passive mixer 110. In some embodiments, the deicer solution includes one or more of inorganic chemical deicer crystals, by way of example and not limitation, sodium chloride, magnesium chloride, calcium chloride, and/or potassium chloride. In some embodiments, the deicer solution includes organic chemical deicer crystals, by way of example and not limitation, one or more of calcium magnesium acetate, potassium acetate, potassium formate, sodium formate, calcium formate, and/or urea. In some embodiments, the deicer solution includes, by way of example and not limitation, one or more of alcohol-based materials, such as, proplene glycol, and/or glycerol. The deicer solution can also include any of various combinations of the inorganic chemical deicer crystals, organic deicer crystals, or alcohol based components described above. In some cases, a pure deicer solution can be applied directly to the intended surface. However, in some embodiments, in order to lower operating costs with limited impact on practical efficiency, the deicer solution is mixed (e.g., diluted) with a diluent (e.g., water) to create a deicer fluid. The deicer fluid is then distributed to the intended surface. The specific blend of deicer solution and diluent can vary based on the desired properties. For example, in some embodiments, the deicer fluid ratio is at least 30% deicer solution (e.g., about 30% to about 99% deicer solution (e.g., about 30% to about 50% deicer solution (e.g., about 35% to about 45% deicer solution (e.g., about 38% to about 42% deicer solution (e.g., about 40% deicer solution))))). In some embodiments, the deicer fluid ratio is about 90% to about 99% deicer solution. In some embodiments, the deicer fluid ratio is about 80% to about 89% deicer solution. In some embodiments, the deicer fluid ratio is about 70% to about 79% deicer solution. In some embodiments, the deicer fluid ratio is about 60% to about 69% deicer solution. In some embodiments, the deicer fluid ratio is about 50% to about 59% deicer solution. In some embodiments, the deicer fluid ratio is about 40% to about 49% deicer solution. In some embodiments, the deicer fluid ratio is about 30% to about 39% deicer solution. In some embodiments, the deicer fluid ratio is at least 40% deicer solution. In some embodiments, the deicer fluid ratio is at least 50% deicer solution.

In some embodiments, the deicer solution container 120 includes a unique connection to the passive mixer 110. The unique connection can increase the likelihood that the user replaces the initial deicer solution container 120 with an OEM replacement. This feature protects the user and the manufacturer from warranty concerns that might stem from counterfeit replacements. In addition, it increases the likelihood that end users do not replace the environmentally friendly deicer solution with a harmful alternative, by way of example and not limitation, methanol or ethylene glycol. In some embodiments, the unique connection is a fitting with a particular shape. In some embodiments, the unique connection is a microchip. In some embodiments, the unique connection is an alternative method of ensuring the user replaces the deicer solution container 120 with an OEM replacement. In some embodiments, the deicer solution is about 100% deicer fluid that can be drawn by a pipe and/or a tube.

In some cases, it can be useful to determine (e.g., predict, detect, etc.) that deicer solution is available when the sensor suite 180 confirms that environmental conditions are likely to promote ice dam formation. As a result, it can be important to be able to check the amount of deicer solution that remains in the deicer solution container 120. In some embodiments, the deicer solution container 120 has a transparent (e.g., clear) windowed wall that allows for visual inspection of the deicer solution. In some embodiments, the deicer solution container 120 includes an ultrasonic sensor that detects the current deicer solution level in the deicer solution container 120. In some embodiments, the ultrasonic sensor provides an alert to the user when the deicer solution levels are low.

The sensor suite 180 can control the operation of the deicer system 100. In some embodiments, the sensor suite 180 incorporates a microcontroller and sensors to measure temperature and moisture in the exterior environment. When the temperature and moisture sensors determine or predict that a predetermined condition is satisfied, the sensor suite 180 can automatically operate a solenoid valve 170 to allow for operation of the deicer system 100. For example, opening the solenoid valve 170 can cause water to begin flowing through the system, permit water mixing with the deicer solution to form deicer fluid, and/or cause dispensing or expulsion of the deicer fluid from the emitters 130 onto the roof 75. In some embodiments, the systems and methods as described herein have a bypass valve for manual operation of the solenoid valve 170 during a power outage. Alternatively or additionally, in some embodiments, the sensor suite 180 includes a timer, wherein the solenoid valve 170 is opened at periodic times (e.g., during times of day), by way of example and not limitation, during the night or other times when the selected surface does not receive direct sunlight.

The emitters 130 dispense the deicer fluid onto the selected surface. In some embodiments, the emitters 130, by way of example and not limitation, are drip emitters. The drip emitters can be a cost effective method of distributing the deicer fluid. For example, the emitters can include simple drip emitters, such as drip irrigation tubing (e.g., tubing with a series of one or more openings (e.g., fluid flow paths)). Additionally, drip emitters can be effective at distributing deicer fluid in a more controlled and predictable way that with traditional nozzles. For example, fluid being expelled from a drip emitter typically flows along a single path leaving each of the openings, rather than being sprayed in a fan-like pattern. Single path deicer fluid can be useful in forming discrete flow paths through an ice dam, rather than covering an entire ice dam in a thin mist of fluid. Furthermore, unlike some deicer systems on the market, the emitters 130 typically do not require high deicer fluid pressure to operate. For example, some conventional deicers utilize traditional "pop-up" sprinkler heads that require a particular fluid pressure to operate. With drip emitters however, a low fluid pressure should not inhibit the effectiveness of the system. In some embodiments, the emitters 130 incorporate directional nozzles to allow for directional application of the deicer fluid. By way of example, the emitters described herein can be configured to operate with fluid that is less than about 70 psi (e.g., less than about 30 psi (e.g., about 10 psi to about 30 psi (e.g., about 10 psi to about 25 psi))). However, the specific liquid pressures can vary. For example, in some cases, to raise the liquid to the top of a one story home, we calculated it would take roughly 8 psi (0.5 psi/ft), which meant that 22 psi was the pressure of the liquid at the emitters, assuming that the inlet pressure is 30 psi and there are no losses. However, changing various parameters, such as increasing the diameter of the tubing or the height of the emitters, could vary the desired pressure at the output.

Figure 3:
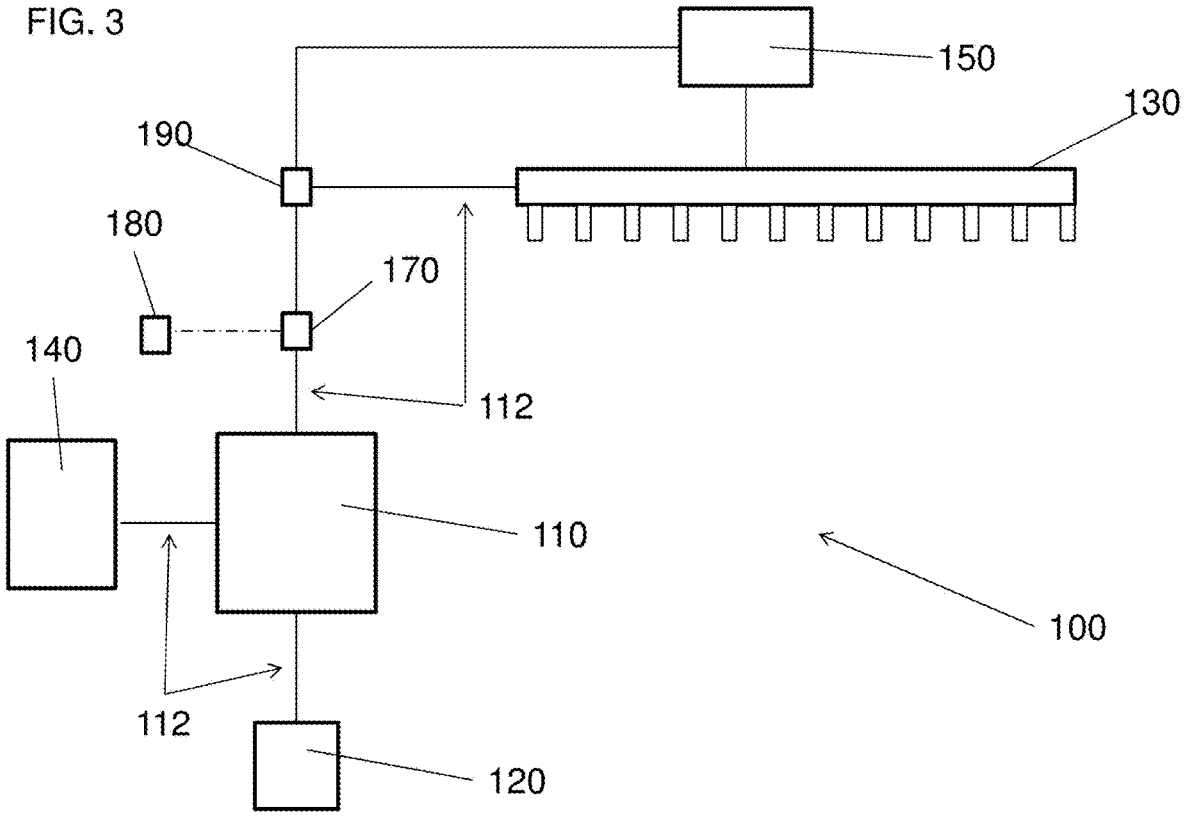
FIG. 3 is a schematic diagram of an example deicer system, further illustrating an example secondary container, allowing for gravity fed operation of the system.

FIG. 3 shows a schematic of an example deicer system 100 that includes a secondary container 150 and a secondary container bypass valve 190. Rural homes can be serviced by wells as their water source 140, and as such, there can be a loss of water pressure to the deicer system 100 during power outages. Unlike some common deicing systems that would require the use of expensive generators or solar panels to either run heating coils or a pump, the incorporation of the secondary container 150 can afford a low cost alternative to generators and solar panels. The secondary container 150 can be installed above the emitters 130 to allow for gravity fed distribution of the deicer fluid, thereby allowing for continued ice dam protection despite the loss of power to the deicer system 100. In some embodiments, the secondary container 150 is integrated into the deicer system 100 fulltime. In some embodiments, the secondary container 150 can be manually incorporated into the deicer system 100 by the user through the operation of the secondary container bypass valve 190. Unless otherwise stated, the system of FIG. 3 can include components that are similar of the same as those described with respect to FIG. 2.

Figure 4:
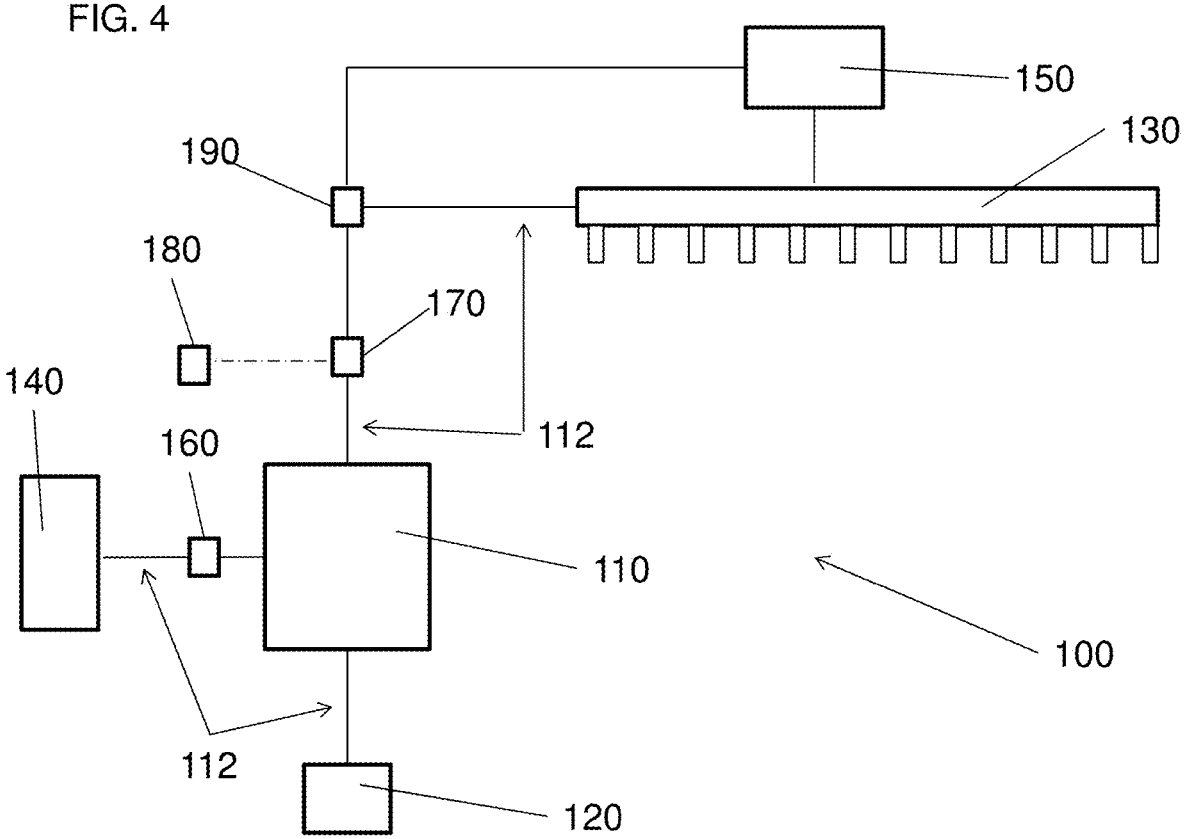
FIG. 4 is a schematic diagram of an example deicer system, further illustrating an example manual pump, allowing for operation of the deicer system despite low, or no, external water pressure.

FIG. 4 shows the schematic of the example deicer system 100 of FIG. 3 further including a manual pump 160. The manual pump 160 provides for additional water pressure when the water source 140 is experiencing lower than usual water pressure. This drop in water pressure can be, by way of example and not limitation, due to a loss of power to the building. The manual pump 160 can operate in conjunction with, or in replace of, the secondary container 150. In some embodiments, the manual pump 160 is a hand pump. In some embodiments, the manual pump 160 is a foot pump. In some embodiments, the manual pump 160 is an alternative pump. The manual pump 160 provides enhanced reliability to users whose water source 140 is either a well or an alternative container, as it allows for continued operation of the deicer system 100 during a power outage. The inclusion of a manual pump 160 is advantageous in applications where the building's water pressure is low, when the deicer system 100 is meant to distribute deicer fluid across numerous surfaces, and/or when the surface to be deiced is particularly high above the ground. Unless otherwise stated, the system of FIG. 4 can include components that are similar of the same as those described with respect to FIGS. 2 and 3.

Figure 5:
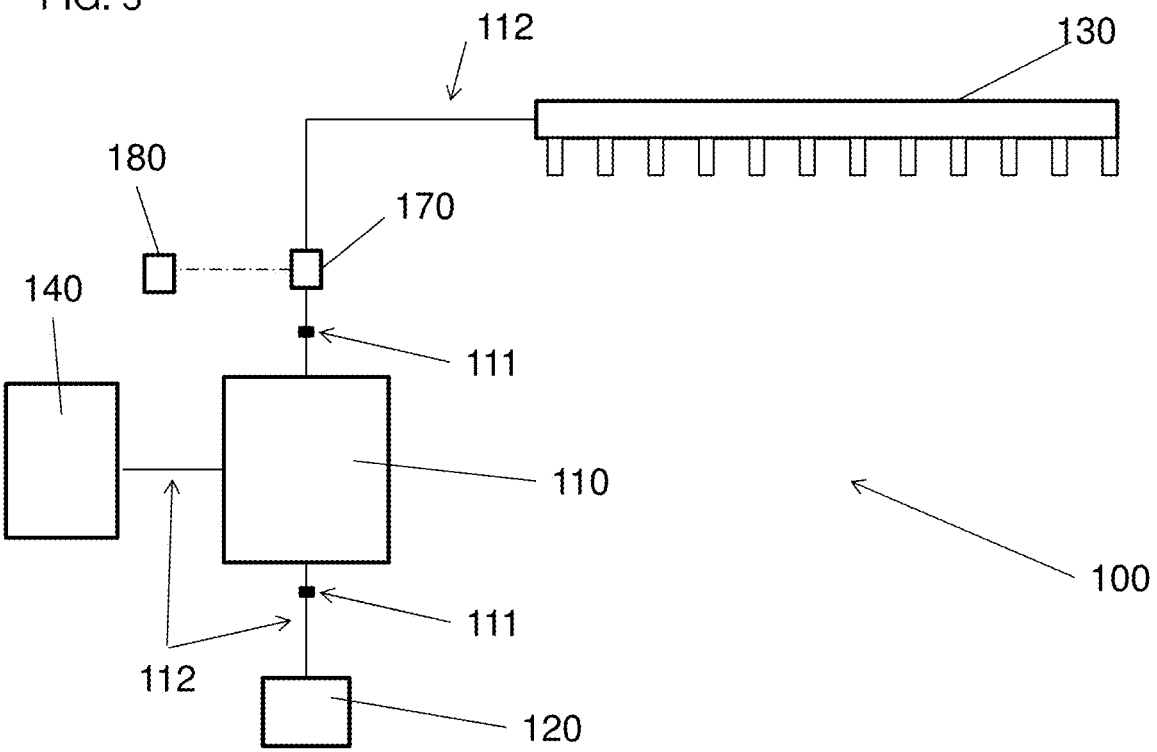
FIG. 5 is a schematic diagram of an example deicer system, further illustrating an example release valve, allowing for purging of the example deicer system after operation.

FIG. 5 shows an example deicer system 100 of FIG. 2 further including release valves 111. In some embodiments, the systems and methods as described herein include a release valve 111 both before and after the passive mixer 110 to allow for purging of the deicer system 100 after use. This process is not necessary after every deicing operation, but can be of interest to users at the end of the winter season. In addition, the release valve 111 provides a way of testing the deicer fluid concentration for maintenance purposes without having to capture the deicer fluid from the emitters 130. Unless otherwise stated, the system of FIG. 5 can include components that are similar of the same as those described with respect to FIGS. 2-4.

Figure 6:
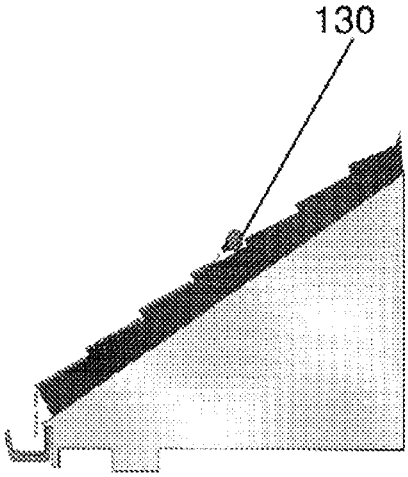
FIG. 6 is a side view of an example emitter applied to a slanted roof.

FIG. 6 is a side view of an example emitter 130 installed on a slanted roof.

Figure 7:
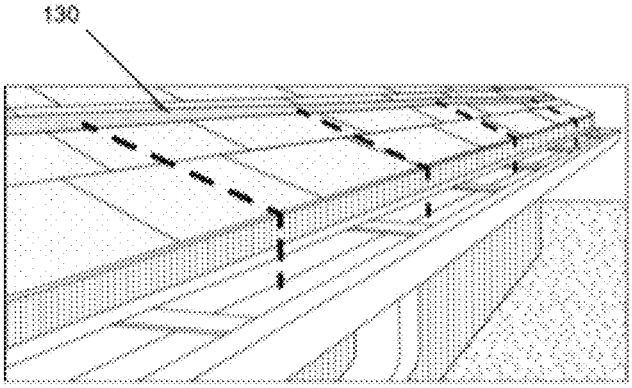
FIG. 7 is a perspective view of an example emitter applied to a slanted roof.

FIG. 7 is a perspective view of an example emitter 130 installed on a slanted roof.

Figure 8:
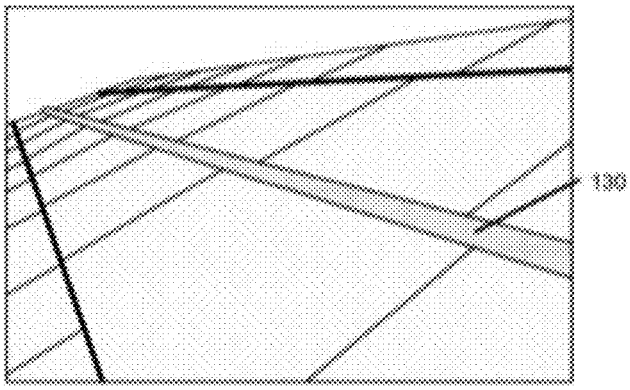
FIG. 8 is a perspective view of an example emitter comprised of irrigation tubing.

FIG. 8 shows the use of irrigation tubing as emitters 130 according to one embodiment of the present application.

Figure 9:
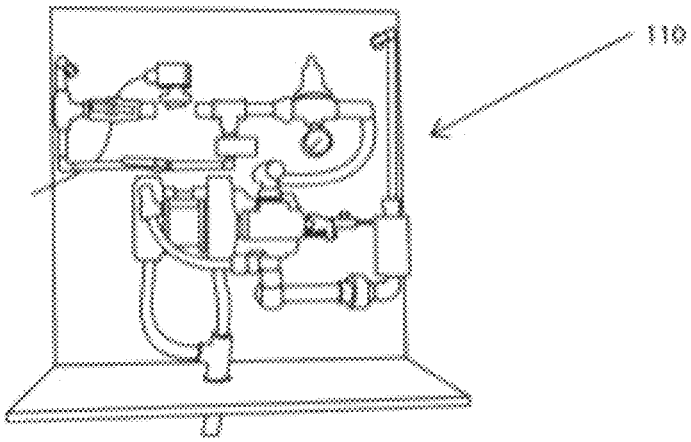
FIG. 9 is a front view of an example passive mixer, wherein the example passive mixer operates through the venturi effect.

FIG. 9 is a front view of an example passive mixer 110 according to one embodiment of the present application. The passive mixer 110 shown, as a representative example, is a HydroBlend® Model #6850.

Figure 10:
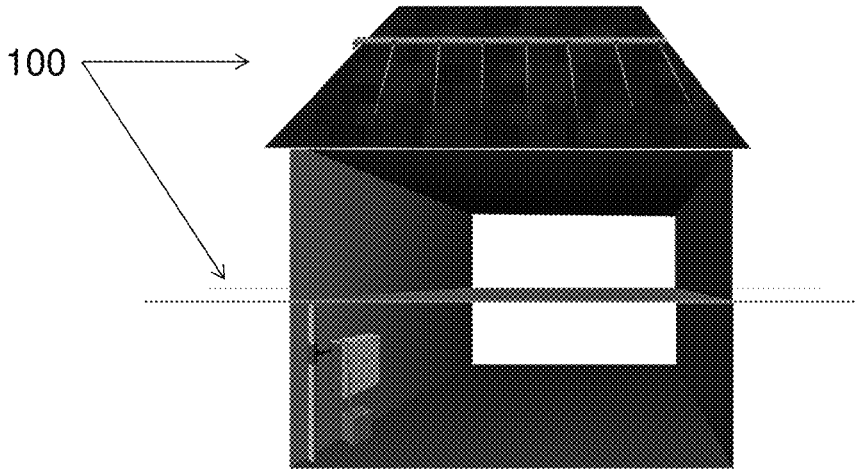
FIG. 10 is a side view of an example deicer system, wherein the example deicer system is installed internally to a residential home.

FIG. 10 is a perspective view of the deicer system 100 installed interior to a home 50 according to one embodiment of the present application.

Figure 11:
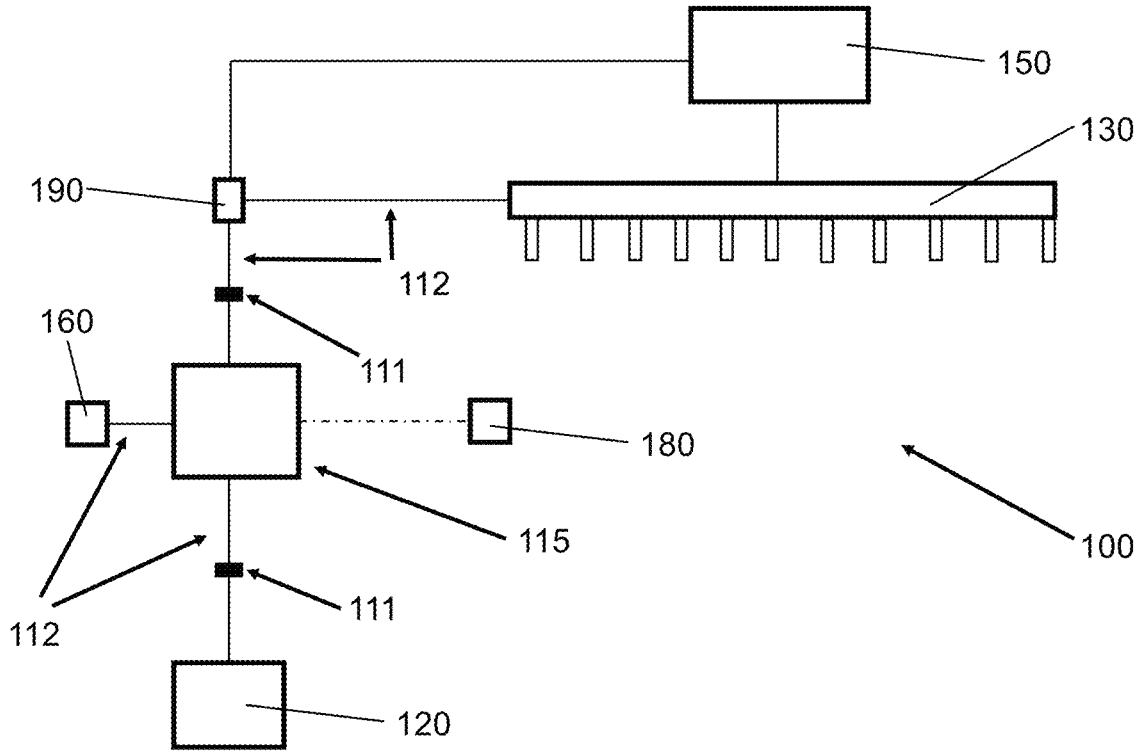
FIG. 11 is a schematic diagram of an example deicer system including an electric pump for operating the deicer system using electricity instead of (or in addition to) water pressure.

FIG. 11 is a schematic diagram of an example deicer system 100 including an electric pump 115 for operating the deicer system 100 using electricity instead of (or in addition to) water pressure. The electric pump 115 enables the system to operate without the use of water pressure or dilution of the deicer solution, which can simplify the components in the system 100. The electric pump 115 draws deicer solution from a deicer solution container 120 at a controlled rate. The electric pump 115 can be operated by a sensor suite 180 and control the flow of deicer fluid to the emitters 130. In some embodiments, there is a manual pump 160. The manual pump 160 draws deicer solution from the deicer solution container 120 when the electric pump is not enabled. This deactivation of the electric pump 115 can be, by way of example and not limitation, due to a loss of power to the building. The manual pump 160 can operate in conjunction with, or in replace of, the electric pump 115. In some embodiments, the manual pump 160 is a hand pump. In some embodiments, the manual pump 160 is a foot pump. The manual pump 160 can be operated without the sensor suite 180 and controlled by a user. The fluid passes through tubing 112 and release valves 111 that are used to purge the deicer system 100 after use. This process is not necessary after every deicing operation, but can of interest to users at the end of the winter season. In addition, the release valves 111 provide a way of testing the deicer fluid concentration for maintenance purposes without having to capture the deicer fluid from the emitters 130. The tubing 112 connects most or all fluid handling components of the deicer system 100 and allows for the flow of the deicer fluid to the emitters 130. Unless otherwise stated, the system of FIG. 11 can include components that are similar of the same as those described with respect to FIGS. 2-5.

In some embodiments, in the electric pump deicer system, the mixer is not needed to power the fluid; however, the mixer can be used to dilute the deicer solution. The deicer solution has to mix with a certain amount of pressurized water to get to the top of the building. In the electric pump deicer system, however, an electromechanical force can be used to pump fluid to the top of the building. This means that there may be no need to dilute the deicer solution (although it can be diluted if it is sold and shipped as a concentrate), so the base model of the system can include simply a pump, tubing, a deicer container, sensors, and emitters. Additional add-ons can also be included, such as the secondary container, the manual pump, and the release valve shown and described above. In some embodiments, the deicer solution can be non-corrosive. In some embodiments, the deicer solution can be biodegradable. In some embodiments, the system can be powered by at least one of a battery or an outlet, e.g. a wall plug.

Referring now to the drawings in general, the illustrations are for the purpose of describing an embodiment of the application and are not intended to limit the application thereto. The above-mentioned examples are provided to serve the purpose of clarifying the aspects of the application, and it will be apparent to one skilled in the art that they do not serve to limit the scope of the following claims. The surface can be, by way of example and not limitation, a roof, driveway, sidewalk, patio, or other surface where the prevention of ice is desired. In some embodiments, the systems and methods as described herein are installed to cover numerous surfaces. The systems and methods as described herein can incorporate numerous bypass valves to provide the user control regarding which, or all, surfaces to apply deicer. The system may be used to distribute a nutrient rich solution for plants during the summer months. By its nature, this application is highly adjustable, customizable and adaptable. The above-mention examples are is just some of the many configurations that the mentioned components can take on. All modifications and improvements have been deleted herein for the sake of conciseness and readability but are properly within the scope of this disclosure.

What is claimed is:

1. A deicer system to distribute a deicing fluid along a roof of a building to limit ice dam formation, the deicer system comprising:

a deicer solution source including a deicer solution;

an electric pump in fluid communication with the deicer solution source, the electric pump configured to distribute the deicer solution;

one or more drip emitters in fluid communication with the deicer solution source, the one or more drip emitters configured to be disposed along the roof to receive the deicer solution and dispense the deicer solution along the roof after snowfall so as to form one or more flow channels through an ice dam without spraying the deicer solution in a fan-like pattern;

a secondary container in communication with a manual pump and the deicer solution source, the secondary container configured to provide gravity-fed distribution of the deicer solution to the one or more drip emitters; and one or more sensors for measuring at least one of temperature or moisture in the exterior environment to predict environmental conditions that promote formation of the ice dam, wherein the one or more sensors are configured to automatically permit flow of the deicer solution to the drip emitters when the environmental conditions that promote formation of the ice dam are predicted.

2. The deicer system of claim 1 wherein the one or more drip emitters include holes for depositing the liquid deicing solution.

3. The deicer system of claim 1 wherein the one or more drip emitters are configured to dispense the deicer solution at a pressure of less than about 70 psi.

4. The deicer system of claim 1 wherein the deicer solution source comprises a container containing the deicer solution.

5. The deicer system of claim 1 wherein the electric pump is connected to an electrical outlet or is battery powered.

6. The deicer system of claim 1, wherein the one or more sensors include at least one sensor for measuring an amount of deicer solution in the deicer solution source.

7. The deicer system of claim 6, wherein the one or more sensors are configured to automatically permit flow of the deicer solution to the drip emitters when the environmental conditions that promote ice dam formation are predicted and there is availability of deicer solution in the deicer solution source for dispensing.

* * * * *